US006695727B1

(12) United States Patent
Kuhn

(10) Patent No.: US 6,695,727 B1
(45) Date of Patent: Feb. 24, 2004

(54) ARROW VANE DEVICE

(76) Inventor: Todd A Kuhn, 5660 Bob White Trail, Mims, FL (US) 32754

( * ) Notice: Subject to any disclaimer, the term of this patent is extended or adjusted under 35 U.S.C. 154(b) by 0 days.

(21) Appl. No.: 10/354,540

(22) Filed: Jan. 30, 2003

(51) Int. Cl.[7] ..... F42B 6/06
(52) U.S. Cl. ..... 473/586
(58) Field of Search ..... 473/578, 585, 473/586

(56) References Cited

U.S. PATENT DOCUMENTS 4,392,654 A * 7/1983 Carella
4,488,728 A * 12/1984 Humphrey
4,502,692 A * 3/1985 Humphrey
5,613,688 A * 3/1997 Carella

* cited by examiner

*Primary Examiner*—John A. Ricci

(57) ABSTRACT

The invention is a system of arrow vanes of novel geometry. The leading edge of each vane is parallel to the long axis of the arrow shaft, and the trailing edge of each vane is deflected out of the plane of the vane like an airfoil causing rotation during flight. All vanes of the invention are identical with all deflected portions facing the same direction when the arrow is viewed down its long axis. The invention also includes one or more vents in the vane surface. Careful placement of these vents decreases aerodynamic drag upon initial release from a bow and also once rotational speed is achieved.

12 Claims, 4 Drawing Sheets

ARROW VANE DEVICE

BACKGROUND OF THE INVENTION

1. Field of the Invention

The present invention relates to the field of archery. Specifically, the invention relates to the vanes or fletching found on arrow devices.

2. Description of the Prior Art

Bowhunting and archery rely on arrows to have two key properties. First, arrows must achieve penetration of the intended target regardless of whether that intended target is a static bulls-eye or a hunted animal. Second, arrows must fly straight and true. Even the most skilled of archers, with the most trained eyes, can not compensate for an arrow that can not find its intended mark. These two great needs are somewhat at odds with one another. Historical solutions have sought to balance these two needs in order to minimize the detrimental effects of each while maximizing the overall result.

The problem of target penetration has been addressed in several ways. Target penetration can be directly correlated to the likelihood of hunting success: an arrow that can not adequately penetrate an intended animal is of little use to a hunter. The overall mass of the arrow could be increased, but more massive arrows are clumsy and must be fired in a high arc to reach the intended target. Simple "field point" arrow tips can provide adequate penetration for targets in competition, but they are not very effective for killing hunted animals. Prior art broadhead arrows were invented to increase effective hunting penetration and success potential. Typically two to four flat, triangular blades are arranged around the forward pointed tip. As the tip enters the intended target, the blades slice a region much greater than the diameter of the arrow shaft. Unfortunately, these broad, flat blades have a pronounced aerodynamic effect that can radically affect the overall stability of the arrow in flight and significantly reduce the precision of flight. Since the majority of hunting tips are broadhead in design, the combined effect of broadhead and fins at opposite ends of an arrow may not promote a stable flight.

Simple fletching, or other guidance fins, were added to the aft end of prior art arrows. Typically, two to four fins are applied parallel to the long axis of the arrow surrounding the aft end. As the arrow sails through the air, these fins are intended to straighten the overall flight path by effectively pushing the tip of the arrow in the right direction. Prior art, commercially available arrows, also teach applying the fins in a slightly helical or off-main axis manner to the arrow shaft. Such an arrow spins, once released, in order to promote a truer flight. However, these same fins typically account for sixty percent of the overall aerodynamic drag experienced by the arrow in flight. Fins of reduced size have less drag but also provide less overall stability. Minimizing drag is important to increase overall range and speed at impact. Virtually all prior art arrow vanes are constructed of materials which flex or bend when the arrow is first released due to aerodynamic forces. As a result they fold almost flat when the arrow is released and do not apply sufficient torque to the arrow to bring it to a speed of rotation adequate to ensure stability until significant deviation from the initial course has occurred. The only prior art vanes which are constructed of rigid plastic either have very high aerodynamic drag due to sharp projecting angles or are incompatible with a standard arrow rest.

SUMMARY OF THE INVENTION

The present invention is a system of arrow vanes that provide excellent main shaft rotation without producing a large amount of aerodynamic drag. A plurality of modest vanes are attached around the aft end of any conventional arrow shaft or integral to the aft end of any conventional arrow shaft. The invention is compatible with all contemporary arrow shafts.

A key feature of the current invention is that each vane constitutes an airfoil, with the airfoils together acting as an axial flow turbine, to maximize the twisting force or torque applied to the arrow while simultaneously minimizing aerodynamic drag at both low and high rates of rotation. To achieve this, the airfoil is a curved surface, like the wing of an aircraft, and also varies in pitch from zero at the base to a maximum pitch at the tip, which may be as great as 30 degrees. When the arrow is rotating rapidly, the portion of the vane near the tip is moving through the air in a spiral path. The gradual variation in pitch along the length of the vane ensures that the portion of the vane near the tip is aligned along the path it follows through the air, minimizing drag. This same principle of changing pitch with radial distance is well established in the design of aircraft propellers and turbines, but has never been applied to the design of arrow vanes.

In the present invention, the geometry of each vane constitutes an airfoil wherein the leading edge of each vane is parallel to the long axis of the arrow shaft, and the trailing edge of each vane is deflected out of the plane of the vane like an airfoil. All vanes of the present invention are identical with all deflected portions facing the same direction when the arrow is viewed down its long axis. In flight, the arrow rotates as a result of airflow over the deflected portion of the vanes much as the control surface on an aircraft wing changes the direction of the aircraft if said control surface is deflected out of the major plane of the aircraft wing.

Another key feature of the present invention is one or more vents in the vane surface. Careful placement of these vents decreases aerodynamic drag upon initial release from a bow and also once rotational speed is achieved.

DESCRIPTION OF THE PREFERRED EMBODIMENTS

Figures 1, 2, 3:
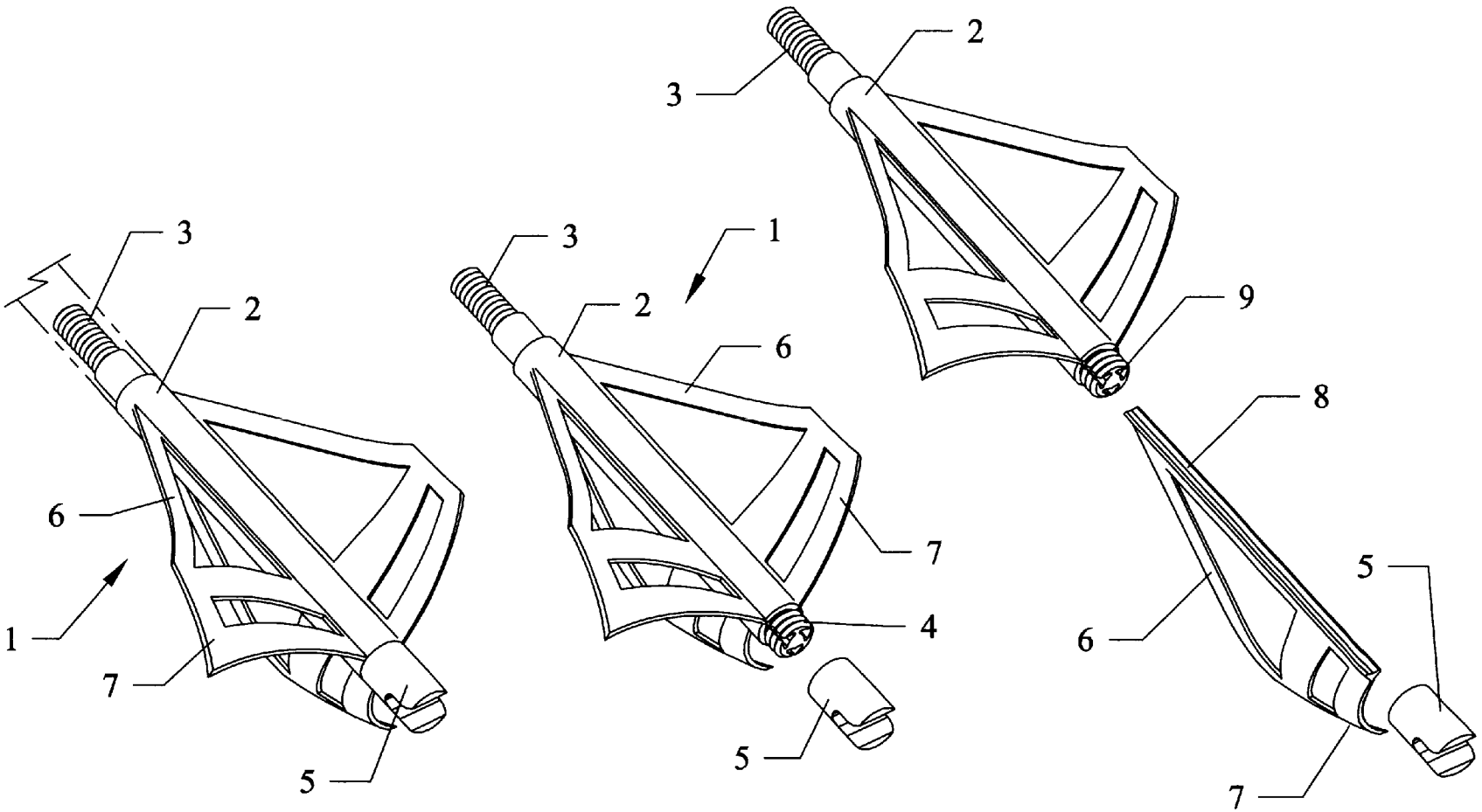
FIG. 1 is an oblique view of a first embodiment of the present invention.
FIG. 2 is an oblique view of a first embodiment of the present invention showing removal of a locking nock.
FIG. 3 is an oblique view of a first embodiment of the present invention showing removal on one vane.

FIGS. 1, 2, and 3 are directed to a first embodiment of the present invention. Arrow vane device 1 is comprised of a cylindrical body 2 with a leading end 3 and a trailing end 4. A plurality of vanes 6 are inserted into longitudinal channels 9 beginning with the trailing end 4 of body 2 and then held in an integral arrangement by nock 5. Nock 5 preferably consists of a countersunk female thread of correct pitch, diameter, and depth to accept the male thread on trailing end 4. Body 2 and nock 5 may be manufactured from any material known in the art of arrow element construction including, but not limited to, wood, metals, plastics, and composites. As an alternative, trailing end 4 may be a smooth shaft of slightly reduced diameter with a nock 5 that is press fit or glued onto trailing end 4.

Leading end 3 of body 2 is of slightly reduced diameter and is used to attach the first embodiment of the present invention to the aft end of a prior art hollow arrow shaft. The drawings describe leading end 3 as a male thread of the correct pitch, diameter, and length to accept a similar female thread on the prior art arrow shaft. As an alternative, leading end 3 may be a smooth shaft of slightly reduced diameter that is press fit or glued into the aft end of said prior art arrow shaft.

The vanes 6 are critical elements of all embodiments of the present invention. FIGS. 9–12 describe an embodiment of the present invention. Each vane 6 includes a leading portion that is parallel to the long axis of the arrow shaft. The leading portion of vane 6 stands perpendicular to the arrow shaft circumference (radially outward), rises in height from its leading tip, and lies in a plane parallel to the long axis of body 2. The trailing portion 7 of vane 6 deviates from the long axis of the arrow shaft in a continuous compound arc. Trailing portion first arches out of the plane of vane 6, much like the control surfaces on the wings of an airplane. Second, trailing portion 7 also arches in a decreasing radius of curvature as a function of vane height, wherein the axis of curvature is perpendicular to said arrow shaft. The effect of these vanes is that of an airfoil during flight, forcing rotation of the entire arrow assembly. Trailing portion 7 preferably does not deviate from the plane of vane 6 by an angle of more than thirty degrees at its apex. All vanes 6 must be of identical geometry.

Figure 5:
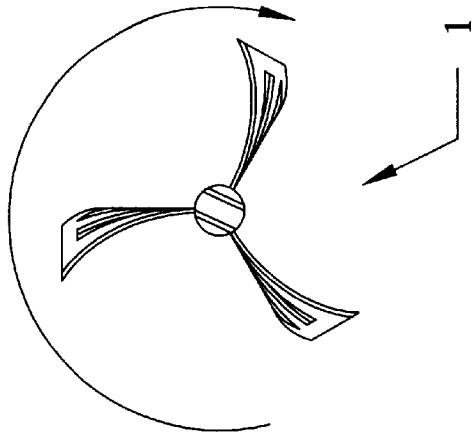
FIG. 5 is an aft-end view of the vanes of a first embodiment of the present invention showing rotational motion during flight.
Figure 4:
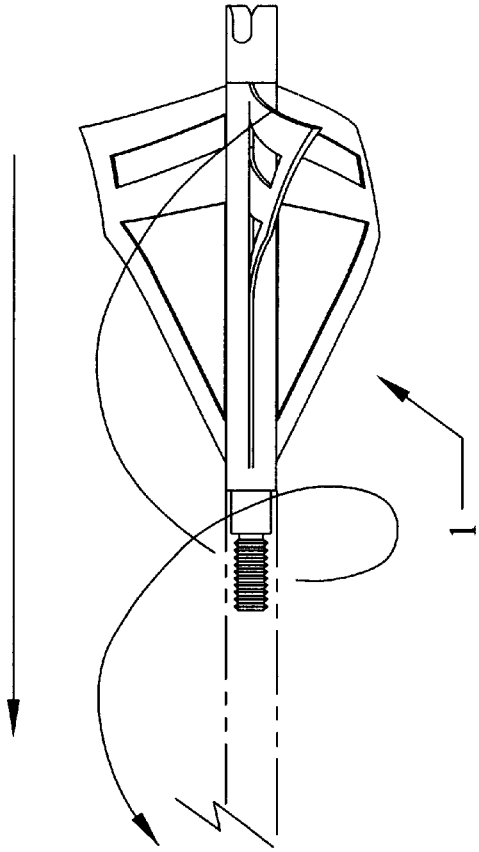
FIG. 4 depicts the rotational motion of the first embodiment of the present invention during flight.
Figure 6:
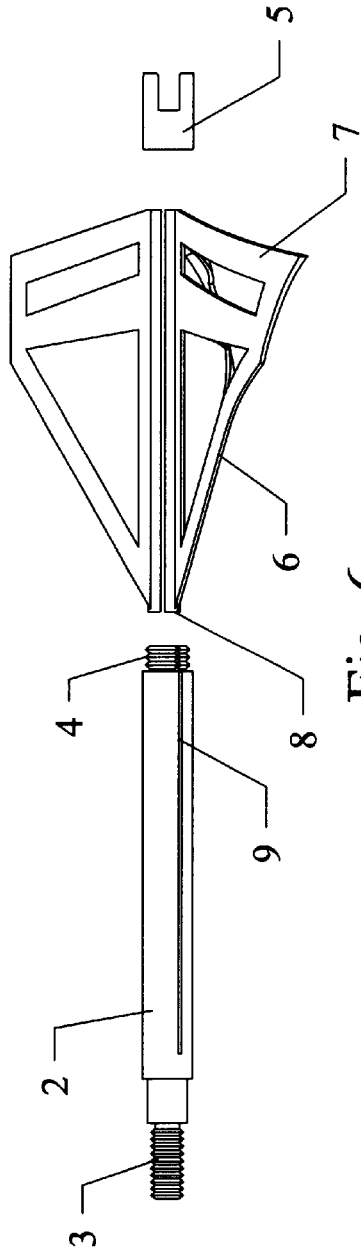
FIG. 6 is an exploded side view of a first embodiment of the present invention.
Figure 8:
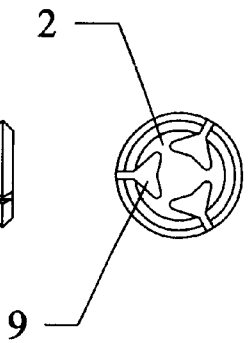
FIG. 8 is an aft view of the body of the first embodiment of the present invention.
Figure 7:
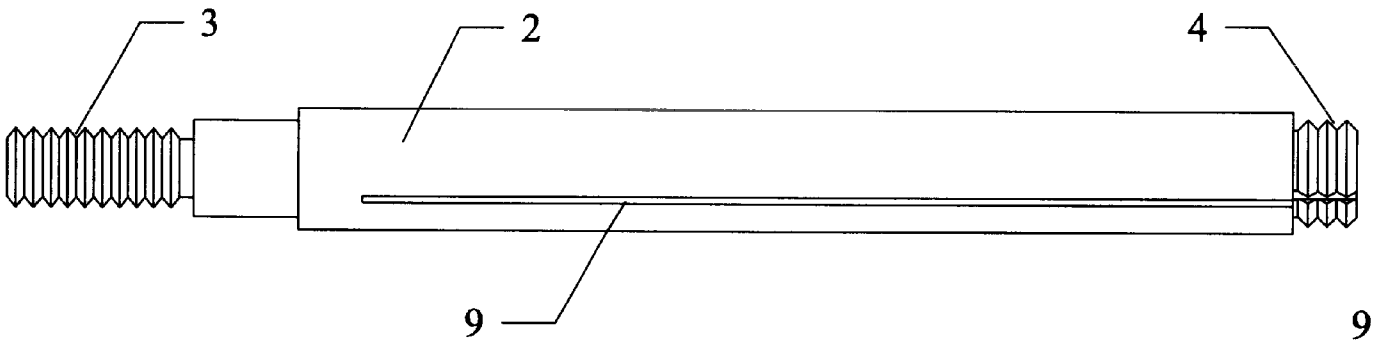
FIG. 7 depicts the body of a first embodiment of the present invention.
Figure 12:
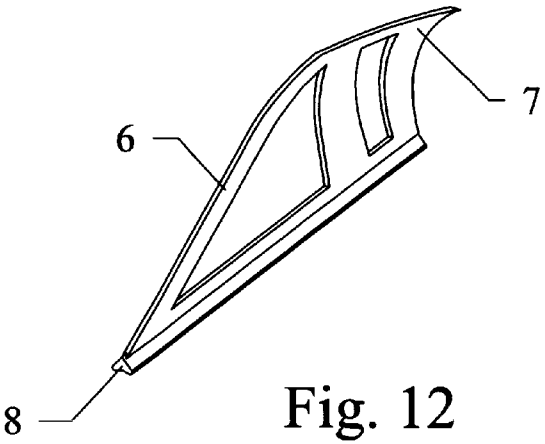
FIG. 12 is a fourth view of an embodiment of the vane of the present invention.
Figure 11:
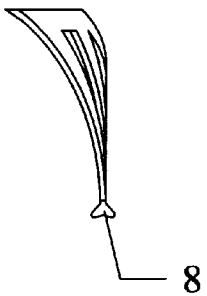
FIG. 11 is a third view of an embodiment of the vane of the present invention.
Figure 9:
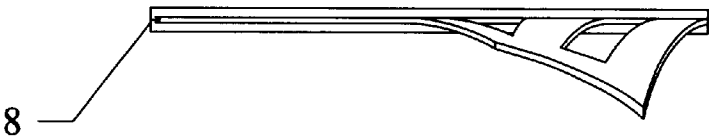
FIG. 9 is a first view of an embodiment of the vane of the present invention.
Figure 10:
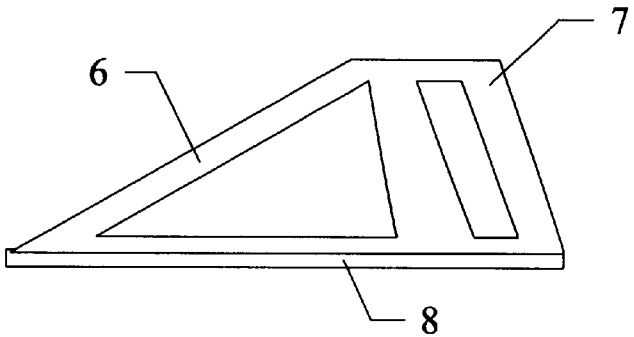
FIG. 10 is a second view of an embodiment of the vane of the present invention.

Vanes 6 may also include one or more holes or vents with very specific functions. First vent 10, which may comprise a single large hole or several small holes, is located exclusively in the flat portion of vane 6 that is parallel to the long axis of the arrow shaft. Second vent 11, which may also comprise a single large, elongated hole or several small holes, is located exclusively in the arched trailing portion 7 of vane 6. Upon initial release from a bow, an arrow including the vanes of the present invention will not be spinning. Airflow glides over the planar portion of vane 6 and strikes the trailing portion 7. This may cause the airflow to become detached and turbulent, just as an airplane wing stalls at a high angle of attack. When airflow over the vane becomes stalled, drag is increased and accuracy is reduced. Second vent 11 permits some air to pass from the underside to the top of the vane during this period, reducing drag and the tendency to stall. As the arrow and vanes begin to rotate, airflow striking the broad flat portion of vane 6 increases rotational drag. To mitigate this resistance to rotational motion, first vent 10 permits airflow through the planar surface of vane 6 thereby decreasing overall rotational drag. The net result is an arrow that spins freely with great range as shown in FIGS. 4 and 5.

In the first embodiment of the present invention, each vane 6 includes a dovetail 8 along its long basal edge as shown in FIGS. 9–12. FIGS. 2, 3, 6, and 8 show the relationship between longitudinal channels 9 in body 2 and the dovetail 8 of said vanes 6. Channels 9 are cut with a dovetail cross section matching the solid dovetail cross-section of dovetail 8 and a connected slit down body 2. Body 2 includes a plurality of at least two channels 9 evenly spaced around the cross section of body 2. In practice, all channels 9 are populated with vanes 6 and then held in an integral arrangement by nock 5. If a vane is damaged, it can easily be removed and replaced in the field by removing nock 5, sliding the damaged vane out of body 2, and replacing it with a new undamaged vane 6.

As an alternative embodiment, vanes 6, with or without dovetail 8 but retaining all of the critical geometrical airfoil elements described previously, are attached by any means known in the art of arrow manufacturing directly to the cylindrical portion of a prior art arrow shaft. Such methods include gluing and thermobonding. This embodiment does have the disadvantages of requiring a jig to initially attach the vanes and vanes damaged in the field are not easily replaced. However, this embodiment retains all the critical features of the vane geometry, which promotes the same aerodynamically efficient, high-spin flight.

The embodiments described herein are meant to be exemplary of the present invention and not limiting.

What is claimed is:

1. An arrow vane system comprising:

a cylindrical body; and a plurality of at least two identical, integral vanes evenly spaced around the circumference of said cylindrical body;

wherein said body has a leading end of reduced diameter capable of attaching said vane to the aft end of an arrow shaft;

wherein said body has a trailing end of reduced diameter capable of attaching said trailing end to an integral arrow nock;

wherein each of said vanes comprises a leading portion that stands perpendicular to the circumference of said arrow shaft, rises in height from its leading tip, and lies in a plane parallel to the long axis of said body; and wherein each of said vanes further comprises a trailing portion that arches away from the long axis of said arrow shaft in a continuous compound arc of decreasing radius of curvature as a function of vane height, wherein the axis of curvature is perpendicular to said arrow shaft.

2. The device of claim 1, wherein each said vane further comprises a first vent located exclusively in said leading portion.

3. The device of claim 2, wherein each said vane further comprises a second vent located exclusively in said trailing portion.

4. The device of claim 1, wherein each said vane further comprises a second vent located exclusively in said trailing portion.

5. The device of claim 1, wherein said body further comprises a plurality of longitudinal channels beginning with said trailing end;

wherein said channels each have a dovetail cross-sectional geometry connected to a longitudinal slit wherein said vanes are removable and include a dovetail such that each said vane slides into each said channel.

6. The device of claim 5, wherein each said vane further comprises a first vent located exclusively in said leading portion.

7. The device of claim 6, wherein each said vane further comprises a second vent located exclusively in said trailing portion.

8. The device of claim 5, wherein each said vane further comprises a second vent located exclusively in said trailing portion.

9. An arrow vane system comprising:

a plurality of at least two identical vanes evenly spaced and integrally attached around the circumference of the aft end of an arrow;

wherein each of said vanes comprises a leading portion that stands perpendicular to the circumference of said arrow shaft, rises in height from its leading tip, and lies in a plane parallel to the long axis of said body; and wherein each of said vanes,further comprises a trailing portion that arches away from the long axis of said arrow shaft in a continuous compound arc of decreasing radius of curvature as a function of vane height, wherein the axis of curvature is perpendicular to said arrow shaft.

10. The device of claim 9, wherein each said vane further comprises a first vent located exclusively in said leading portion.

11. The device of claim 10, wherein each said vane further comprises a second vent located exclusively in said trailing portion.

12. The device of claim 9, wherein each said vane further comprises a second vent located exclusively in said trailing portion.

* * * * *